US005603291A

United States Patent [19]

Al-Kaheli

[11] Patent Number: 5,603,291

[45] Date of Patent: Feb. 18, 1997

[54] INTERNAL COMBUSTION ENGINE WITH VALVE BUILT INTO PISTON HEAD

[76] Inventor: Ismail A. Al-Kaheli, 1945 N. College Ave., Apt. #3, Bloomington, Ind. 47404

[21] Appl. No.: 557,467

[22] Filed: Nov. 14, 1995

[51] Int. Cl.[6] ..... F01L 11/00

[52] U.S. Cl. ..... 123/47 R

[58] Field of Search ..... 123/47 R, 47 AA

[56] References Cited

U.S. PATENT DOCUMENTS

| | | | |
|---|---|---|---|
| 1,744,157 | 1/1930 | Browne | 123/47 K |
| 3,301,234 | 1/1967 | Reilly | 123/47 R |
| 4,455,974 | 6/1984 | Shapiro et al. | 123/47 R |
| 4,708,096 | 11/1987 | Mroz . | |
| 5,186,137 | 2/1993 | Salzmann . | |
| 5,188,066 | 2/1993 | Gustavsson . | |
| 5,213,073 | 5/1993 | Murata et al. . | |

OTHER PUBLICATIONS

"Theory and Operation of Diesel Engines; Part 1; Fundamental Operating Principles," Cummins Engine Company, Inc.; Copyright 1972. Bulletin No. 985616–R.

"2 Stroke vs. 4 Stroke," Outdoor Life Magazine; Published: Jul., 1995.

Chapter Three: Engine, Transmission, and Clutch. "Clymer Suzuki 380–750cc Triples—1972–1977 Service Repair Maintenance." pp. 23–26. Eighth printing, Oct., 1988.

*Primary Examiner*—Marguerite McMahon

*Attorney, Agent, or Firm*—Woodard, Emhardt, Naughton, Moriarty & McNett

[57] ABSTRACT

An internal combustion engine with an exhaust valve formed in the upper surface of the piston and driven by a valve stem connected to the engine crankshaft by an operating arm mounted parallel to the connecting rod and axially movable with respect thereto by means of a cam follower and rolling engagement with a cam on the connecting rod journal of the crankshaft. At least one exhaust tube is mounted in the cylinder and secured to the piston and more specifically to an exhaust chamber formed in the piston below the exhaust valve. The exhaust tube is a telescoping tube which extends from the piston to a wall of the engine block.

9 Claims, 3 Drawing Sheets

INTERNAL COMBUSTION ENGINE WITH VALVE BUILT INTO PISTON HEAD

BACKGROUND OF THE INVENTION

This invention relates to internal combustion engines, and more particularly, to improved valve arrangements for internal combustion engines.

Intake and exhaust valves or ports have been well known since the dawn of motor vehicles to be fundamental parts of an internal combustion engine. Basic designs for a conventional four-stroke engine include an intake valve and an exhaust valve in the cylinder head above each piston, and basic designs for a two-stroke engine include one or two valves, e.g., exhaust valves, in the cylinder head and one or two ports, e.g., intake ports, in the side wall of the cylinder. See, for example, "Theory and Operation of Diesel Engines, Part I, Fundamental Operating Principles," published by Cummins Engine Company, c. 1972.

Conventional two-stroke engines burn more oil than comparable four-stroke engines, due in many cases to the addition of oil to the fuel for lubrication of the cylinder walls. Two-stroke engines lubricated by means of oil pumps rather than oil in the fuel also allow oil to enter the combustion chamber in normal use. For example, in an engine with a sidewall intake port, lubricating oil is supplied to the cylinder wall at the height of and above the intake port, which of course is exposed to the combustion chamber when uncovered by the piston on its downstroke. The resulting oil consumption and smoke are well known disadvantages of two-stroke engines.

It is also known to have more than one valve of the same type in a cylinder head. For example, two exhaust valves for a single cylinder in a two-stroke engine are conventional, as is a four-stroke engine design with four valves per cylinder, two for intake and two for exhaust. This inventor is unaware of any engine design in which a cylinder is provided with four valves all of the same type, for example, four intake valves or four exhaust valves. This is the case even in two-stroke engines with sidewall intake ports, in which there would appear to be sufficient space for more than two overhead exhaust valves per cylinder. This represents the present state of the art to this inventor's knowledge, despite the general awareness that multiple valves in a single cylinder directly affect how efficiently an engine receives air. The amount of air retained in the cylinder directly affects the amount of fuel that can be burned and thus power output. Particularly in diesel engines, including two-stroke and four-stroke diesel engines, excess clean fresh air is necessary, and lack of sufficient air results in power loss, smoke, excessive exhaust temperature and reduced engine life. Thus, there remains a need for improved valve arrangements for internal combustion engines.

SUMMARY OF THE INVENTION

The present invention overcomes these and other disadvantages of the prior art with an internal combustion engine having a piston with a built-in valve. A valve is formed in the upper surface of a piston reciprocatingly mounted in the cylinder of the engine. In the preferred embodiment the valve built into the piston is driven by a valve stem connected to the engine crankshaft, and is employed as an exhaust valve, although it is contemplated that the valve in the piston could alternatively be used as an intake valve.

A general object of the present invention is to provide an improved internal combustion engine.

Another object of the invention is to provide improvements in valve arrangements for internal combustion engines.

Another object of the invention as applied to two-stroke engines is to provide a cleaner burning engine producing less smoke while offering the fundamental advantages of two-stroke design, primarily a smaller, lighter engine for a given power rating, due to a power stroke in each cylinder for every revolution of the crankshaft instead of a power stroke every other revolution as in a four-stroke engine.

A further advantage applicable to two-stroke engines is better control of valve timing than is possible with intake ports and exhaust ports, which are fixed in position in the cylinder wall and consequently constrained to fully close on the piston upstroke at the same point where they begin to open on the downstroke. With the present invention, valve opening and closing can be set independently, e.g., by design of the cam lobe, for both the intake and exhaust valves.

The engine of this invention will be useful in automobiles, trucks, motorcycles, heavy equipment and other applications.

These and other objects and advantages of the present invention will be more apparent upon reading the following detailed description in conjunction with the accompanying drawings.

DESCRIPTION OF THE PREFERRED EMBODIMENT

Figure 1:
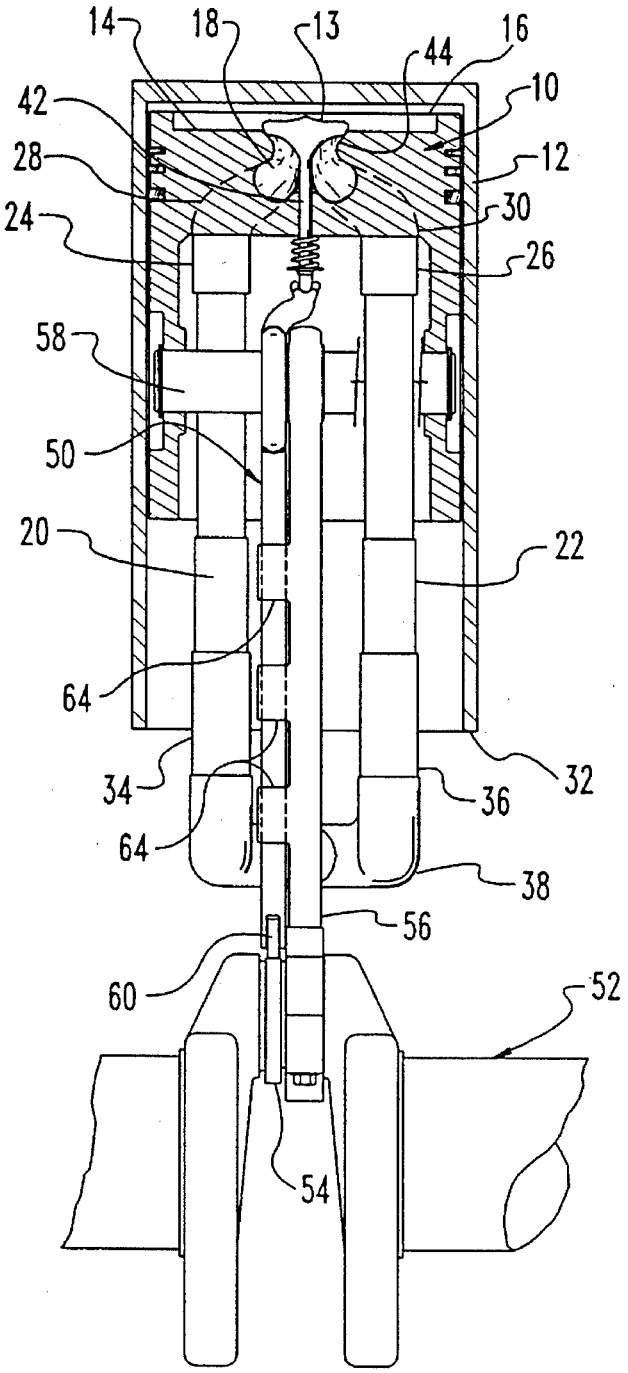
FIG. 1 is a side view, i.e., perpendicular to the logitudinal axis of the crankshaft, of one example of a cylinder having a piston with a built-in valve according to the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
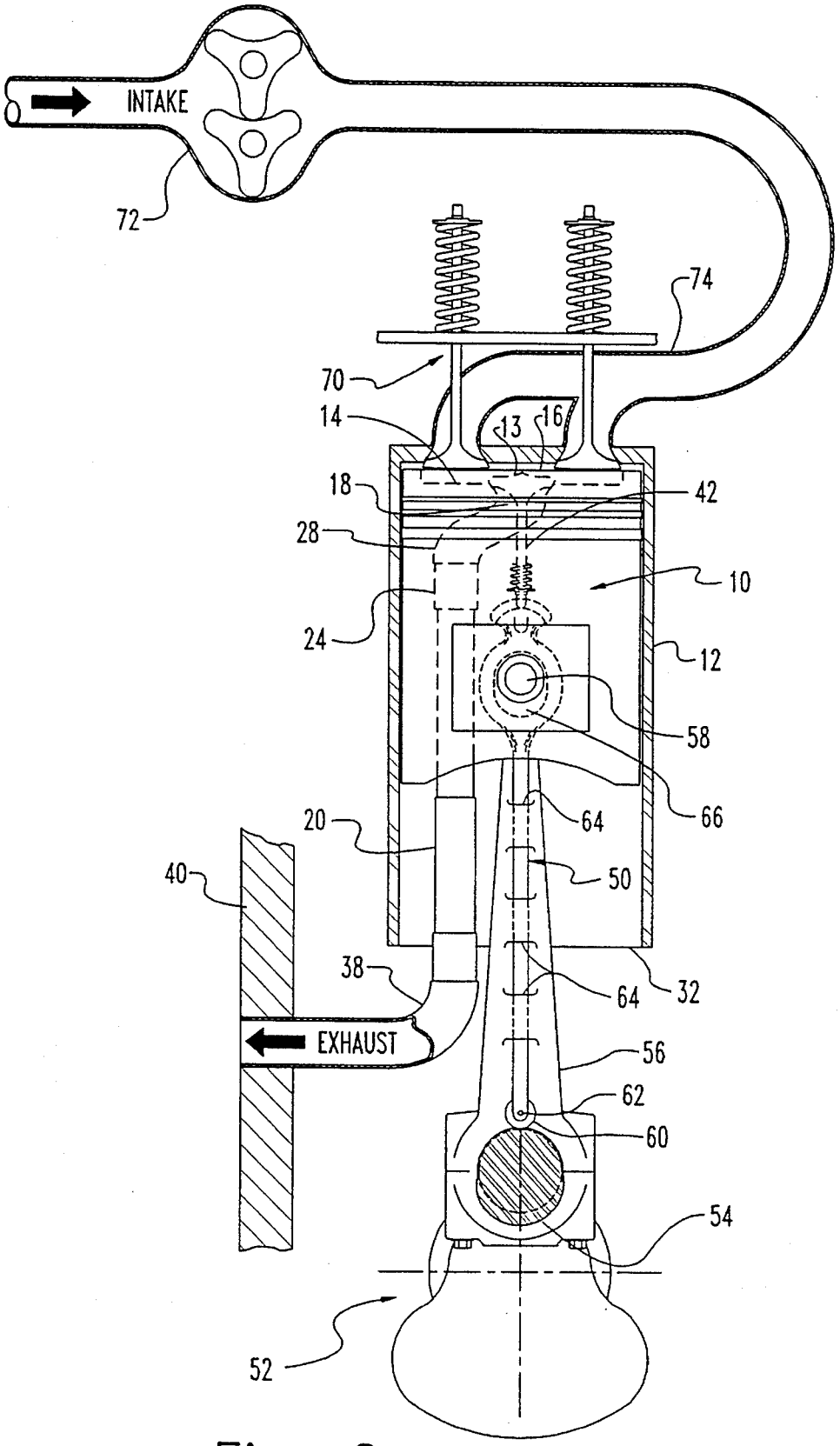
FIG. 2 is an end view of the cylinder shown in FIG. 1.

With combined reference to FIGS. 1 and 2, the preferred embodiment of the present invention includes a piston 10 reciprocatingly mounted in a cylinder 12 of an engine which may, and commonly would have, more than one such cylinder but is shown with one cylinder for illustration purposes only. The piston has a valve 13 formed in its upper surface 14, which in the disclosed embodiment is recessed as shown such that the uppermost central point of the valve is no higher than the outer edge 16 of the piston upper surface. The piston is cast or machined to have a cavity 18 below the built-in valve 13 and extending to two telescoping tubes 20 and 22 which are secured at their upper ends 24 and 26 to the bottom portions 28 and 30 of the cavity 18 in the piston and which extend downwardly therefrom to a point below the bottom 32 of the cylinder wall where the bottom ends 34 and 36 of the telescoping tubes are secured to an exhaust tube junction 38 which is mounted in the side wall 40 of the engine block, as further illustrated detail in FIG. 3.

Figure 3:
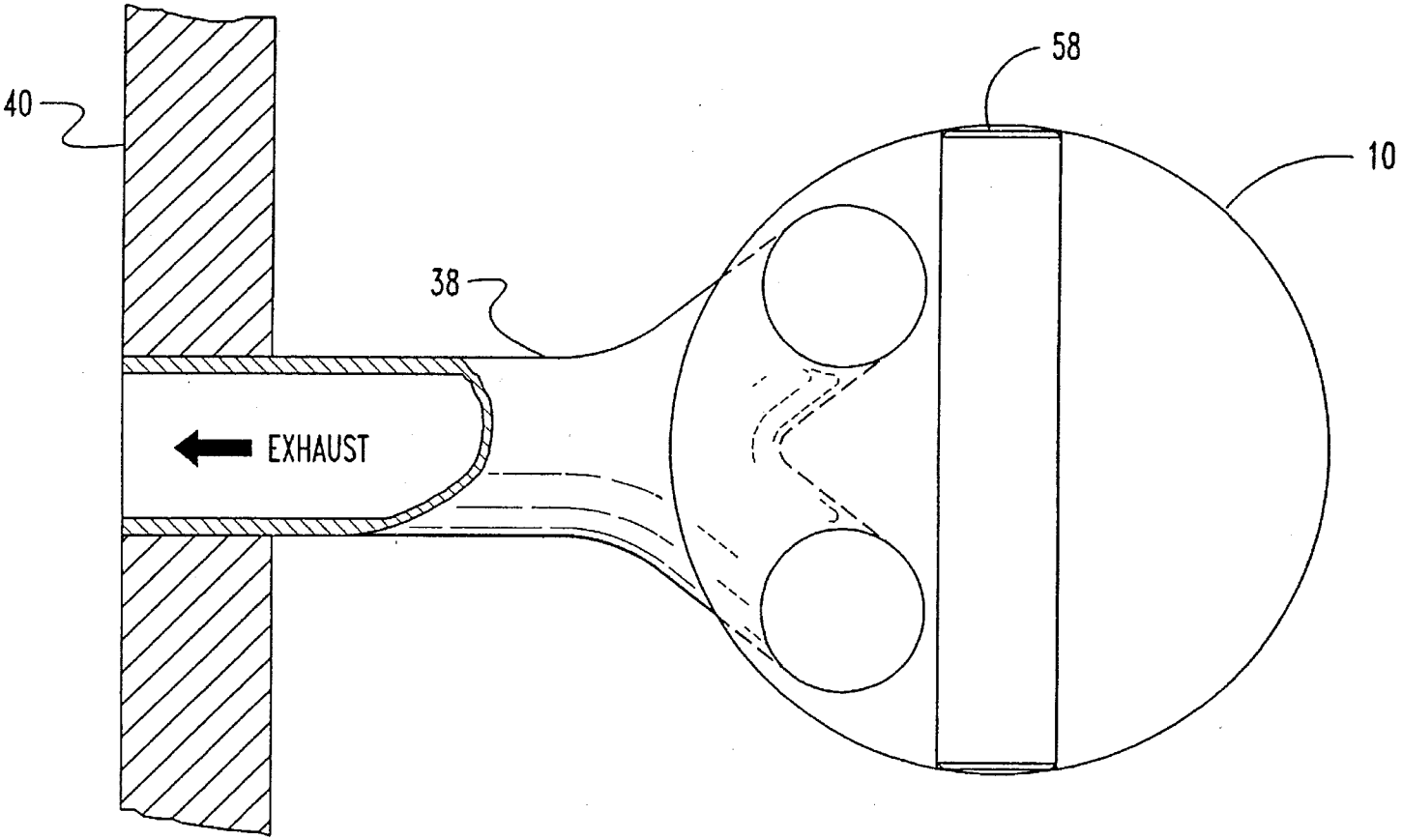
FIG. 3 is a top view of the piston of FIG. 1, particularly illustrating the construction of the exhaust tube section mounted in the wall of the engine block.

An exhaust manifold (not shown) is connected to the outside surface of the engine block wall in communication with the exhaust line shown in FIGS. 2 and 3. The exhaust gases are allowed to flow from the exhaust manifold through the remainder of the exhaust system of the vehicle in a conventional manner.

Figure 1A:
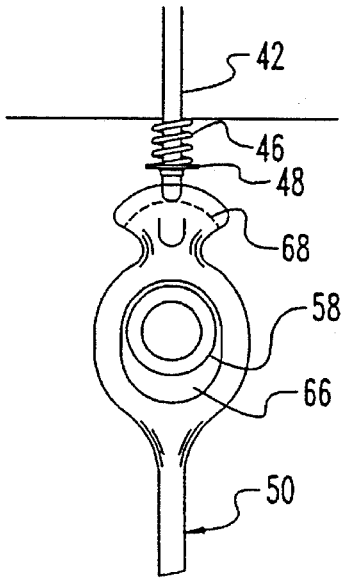
FIG. 1A is an end view, i.e., along the longitudinal axis of the crankshaft, of the upper portion of the operating arm for the built-in valve of FIG. 1.

The valve is secured in place in the piston by an integral valve stem 42 slidably mounted in a valve guide portion formed in the piston for this purpose, and is spring biased toward the valve seat 44 by means of a spring 46 and clip 48 as shown in further detail in FIG. 1A. The valve stem and valve are driven upwardly by an operating arm 50 which extends between the bottom of the valve stem and the crankshaft 52, which is provided with a cam lobe 54 adjacent to the journal for the connecting rod 56, which is pivotally connected to the piston by means of a connecting pin 58 which is mounted in the piston in a conventional manner. The operating arm includes a rolling cam follower 60 fastened by a pin 62 to the bottom point thereof, and the operating arm is constrained to axial motion with respect to the connecting rod by means of flanges 64 in which the operating arm is preferably slidably mounted. The operating arm preferably has a horizontal cross-section at least in the portions thereof extending through the flanges, and the flanges are correspondingly shaped to prevent twisting of the operating arm with respect to a connecting rod. The telescoping tubes are preferably each formed of a ceramic sleeve in a metal pipe, or other materials capable of providing adequate heat resistance and an adequate seal. Although several relatively movable sections are illustrated for each telescoping tube, each tube may have fewer sections, e.g., two sections of approximately equal length sufficient to accommodate the full stroke of the piston.

As shown in FIG. 1A, the operating arm is provided with an eyelet 66 sufficiently large and sufficiently long to pass around the connecting pin and allow vertical motion of the operating arm relative thereto without contact therebetween. The operating arm is provided with a curved upper end 68 to provide a sliding surface for the valve stem as the operating arm is pivoted along with the connecting rod.

The cam surface of cam lobe 54 may be shaped to provide maximum extension of the operating arm, and consequently the full opening state of the exhaust valve, when the piston is at approximately bottom dead center, i.e., at the bottom of its stroke, and to provide for a maximum retraction of the operating arm and the fully closed state of the valve when the piston is at approximately top dead center, i.e., at the top of its stroke. The top dead center position is illustrated in FIGS. 1 and 2. The cam for the operating arm is preferably shaped and sized such that exhaust valve 13 opens when the piston is approximately two-thirds of the way down and closes when the piston is approximately one-third of the way up. The location and shape of the eccentric lobe on the cam determine when the exhaust valve opens and closes, and may vary from the above-mentioned preferred timing in certain applications. For example, with good air flow through the cylinder, the exhaust valve could remain open for a shorter time period, and the cam would be shaped accordingly.

The intake valves 70, shown in FIG. 2, control the flow of fresh air from a pump or blower 72 and intake manifold 74 into the cylinder. The intake valves are simultaneously reciprocated by a camshaft which, in a two-stroke engine, turns at the same speed as the crankshaft. This is accomplished in a conventional manner by connecting gears of the same size on the camshaft and crankshaft, or via a timing belt or chain or other mechanism for causing the two shafts to rotate at the same speed.

As will be apparent to those skilled in the art from the drawings in combination and particularly from FIG. 3, exhaust tubes 20 and 22 are offset from piston pin 58 and connecting rod 56 to maintain adequate clearance during operation. That is, the exhaust outlet points of the cavity formed in the piston are located to the left of the piston pin, from the end view perspective of FIG. 2, with one behind the other with enough space in between for movement of the connecting rod. This arrangement of the exhaust tubes in quadrants defined by the axis of the piston pin and a perpendicular line through the center thereof is further illustrated in FIG. 3. Although two exhaust tubes are shown, the number and arrangement of such tubes can be varied. For example, two additional exhaust tubes may be located on the other side of the piston pin and exhausted to the opposite side wall of the engine block if desired. Alternatively, in some applications it may be suitable to have a single exhaust tube, although it is believed that the pair of exhaust tubes as illustrated provides better exhaust gas flow. Furthermore, the size of the valve in the piston head may be increased if desired and the size of the cavity in the piston may be correspondingly increased, in order, for example, to provide greater or more efficient exhaust gas flow. The exhaust tubes in each quadrant are preferably sized to essentially fill the available space while maintaining a minimal clearance between themselves and the piston pin and other moving parts. It is important to arrange the exhaust tubes such that they clear the counterweights on the crankshaft during engine operation, and for this purpose it may be necessary in some applications to provide an inch or two or more of additional space between the crankshaft and the bottom of the cylinder, and consequently to employ connecting rods and operating arms of correspondingly greater length.

Furthermore, intake and exhaust valves may both be located in the piston head, offset from the center thereof and provided with separate cavities in the piston and, of course, separate tubes extending from the respective cavities to separate intake and exhaust points in the cylinder wall. Separate operating arms and associated cams would also be provided on opposite sides of each connecting rod in this embodiment.

The engine according to the present invention operates with a conventional two-stroke engine cycle. In the case of a diesel engine, air alone is supplied via the intake valves to the cylinder and is compressed within the cylinder by upward motion of the piston. The air temperature rises in response to the compression, and fuel is injected into the cylinder by means of a fuel injector (not shown) which is typically positioned in the cylinder head in the center of the cylinder. The fuel is injected when the piston is near top dead center, at which point ignition occurs and the resulting combustion creates forces on the piston which cause it to move down. When the piston is approximately two-thirds of the way down, the exhaust valve begins to open and the cylinder pressure drops. Shortly thereafter, still on the downstroke, the intake valves begin to open, and fresh air enters the cylinder. This initiates a scavenging process in which fresh air blows spent exhaust gas out through the exhaust valve, which, as noted above, is wide open when the piston is at the bottom of its stoke. Flywheel inertia and, in the case of multi-cylinder engines, a power stroke in another cylinder cause the piston to move up; the exhaust valve begins to close when the piston starts the upstroke and then fully closes when the piston is approximately one-third of the way up. At this time the intake valve is closed in the case of a diesel engine, whereas in the case of a gasoline engine the gas intake valves close after the exhaust valve. This is the compression stroke, during which the previously mentioned compression of air and consequent temperature rise occurs within the cylinder. Near the top of the stroke, fuel is injected and the cycle begins to repeat itself.

It is contemplated that the engine as described herein would be water cooled, for example, by a water jacket around the cylinders as in a conventional four-stroke engine. Similarly, it is contemplated that the engine would be provided with an oil lubrication system including an oil pump as in a four-stroke engine.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. An internal combustion engine having a piston with a built-in valve, comprising:

a cylinder;

a piston reciprocatingly mounted in said cylinder, said piston having an upper surface;

a crankshaft connected to said piston; and a valve formed in said upper surface of said piston, wherein said valve is driven by a valve stem connected to the crankshaft, further comprising an exhaust tube mounted in said cylinder and extending into said piston, wherein said piston defines an exhaust chamber below said valve and extending to the open upper end of said tube, said tube sliding relative to said piston during operation of said engine.

2. The internal combustion engine of claim 1, wherein said exhaust tube runs from said piston exhaust chamber to a wall of the engine block.

3. The internal combustion engine of claim 2, further comprising a pump-driven exhaust line in the exhaust system of the vehicle.

4. The internal combustion engine of claim 3, further comprising a plurality of intake valves in the head of said cylinder.

5. The internal combustion engine of claim 4, wherein said piston includes a valve stem guide extending vertically through a portion of said exhaust chamber.

6. The internal combustion engine of claim 5, wherein said valve stem is connected to the crankshaft by an operating arm and a cam lobe on the crankshaft adjacent to the piston connecting rod journal.

7. The internal combustion engine of claim 6, wherein said operating arm includes a rolling cam follower.

8. The internal combustion engine of claim 7, further comprising means for constraining said operating arm to axial motion with respect to said connecting rod, a ball surface on the lower end of said valve stem, and a corresponding slide channel on the upper end of said operating arm adapted to receive said ball surface.

9. An internal combustion engine having a piston with a built-in valve, comprising:

a cylinder;

a piston reciprocatingly mounted in said cylinder, said piston having an upper surface;

a crankshaft connected to said piston; and a valve formed in said upper surface of said piston, wherein said valve is driven by a valve stem connected to the crankshaft, said valve stem is connected to the crankshaft by an operating arm and a cam lobe on the crankshaft adjacent to the piston connecting rod journal, and said operating arm includes a rolling cam follower, and further comprising means for constraining said operating arm to axial motion with respect to said connecting rod, further comprising a ball surface on the lower end of said valve stem and a corresponding slide channel on the upper end of said operating arm adapted to receive said ball surface.

* * * * *